United States Patent [19]

Ringer

[11] Patent Number: 4,742,915

[45] Date of Patent: May 10, 1988

[54] FOLDABLE BASKET

[76] Inventor: Sam Ringer, 5458 Greenleaf, Skokie, Ill. 60077

[21] Appl. No.: 917,693

[22] Filed: Oct. 10, 1986

[51] Int. Cl.[4] ..... B65D 5/22; B65D 5/46

[52] U.S. Cl. ..... 206/575; 206/459; 229/52 A; 229/41 B; 229/109; 229/914

[58] Field of Search ..... 206/459, 575, 224, 232, 206/44 K; 217/125; 229/41 B, 41 C, 52 A, 914, 110, 178, 108, 109

[56] References Cited

U.S. PATENT DOCUMENTS

| | | | |
|---|---|---|---|
| Re. 25,050 | 10/1961 | Hamilton | 229/178 |
| 2,632,595 | 3/1953 | Finkbone | 229/914 |
| 2,751,138 | 6/1956 | Laver | 229/110 |
| 2,951,615 | 9/1960 | Crane | 217/125 |
| 3,151,801 | 10/1964 | Yesak | 229/52 A |
| 3,261,533 | 7/1966 | Repking | 229/41 C |
| 3,727,826 | 4/1973 | Shepherd | 229/178 |
| 4,058,248 | 11/1977 | McArdle | 229/914 |
| 4,177,917 | 12/1979 | Webinger | 229/116 |
| 4,365,738 | 12/1982 | Densen | 206/459 |
| 4,584,042 | 4/1986 | Wandroik | 206/575 |
| 4,632,251 | 12/1986 | Sheffer | 206/577 |

FOREIGN PATENT DOCUMENTS

| | | | |
|---|---|---|---|
| 294126 | 8/1967 | Australia | 229/110 |
| 1102592 | 5/1955 | France | 229/52 A |
| 1320926 | 2/1963 | France | 229/41 C |

*Primary Examiner*—Jimmy G. Foster

*Attorney, Agent, or Firm*—Hill, Van Santen, Steadman & Simpson

[57] ABSTRACT

There is disclosed herein a foldable blank for use in forming a basket-like container and which may be part of a kit.

The blank includes an eight-sided base and eight tab-like wall sections foldably secured to the base along each side at a base score line. Securement slots are formed in the base adjacent the score lines. Each wall section includes an outer wall panel which is secured at one end to the base. A triangular locking panel is secured to a side edge of the outer panel and a top edge panel to the other end of the outer panel. An inner wall panel is secured at one end to the top edge panel and has a securement tab at the other end. The wall sections are pivoted upwardly along the base score line, the locking panel of an adjacent section positioned against the inward surface of the outer panel, and the inner panel folded downwardly to trap and lock the locking panel in position. The inner panel securement tab engages the securement slot and locks the inner panel in position. The assembly is done sequentially so as to form upright walls for the container.

7 Claims, 2 Drawing Sheets

FIG. 1
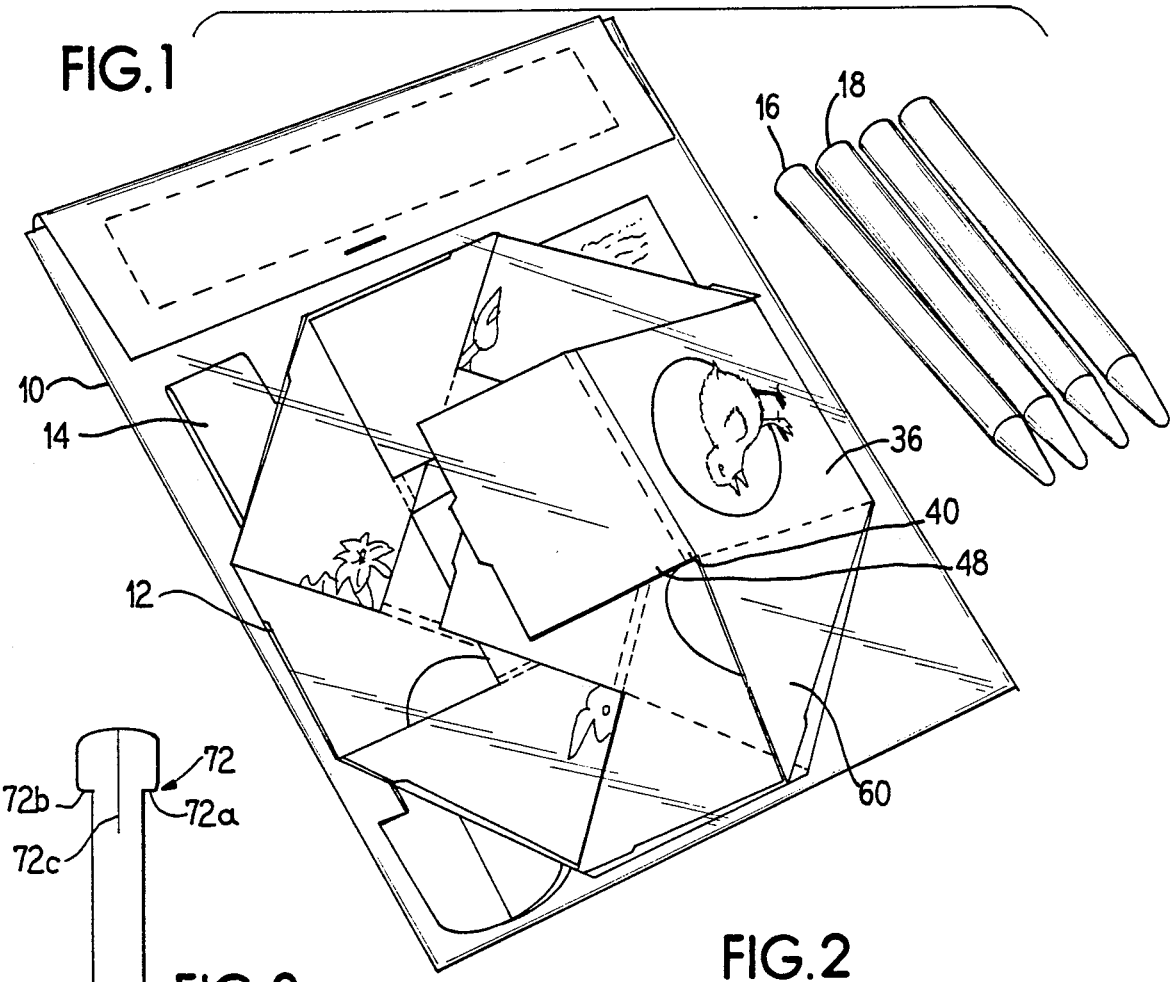
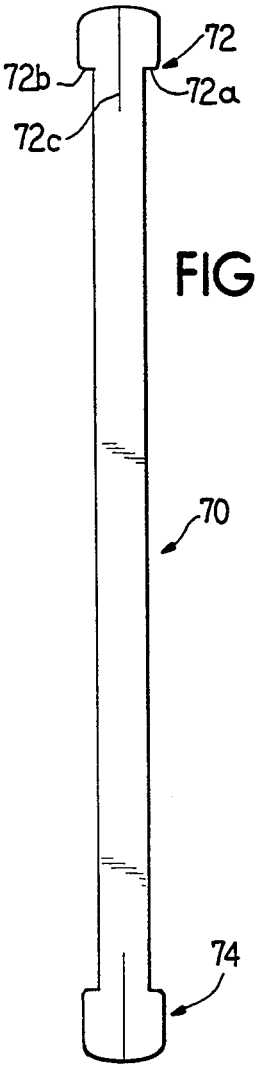
FIG. 3
FIG. 2
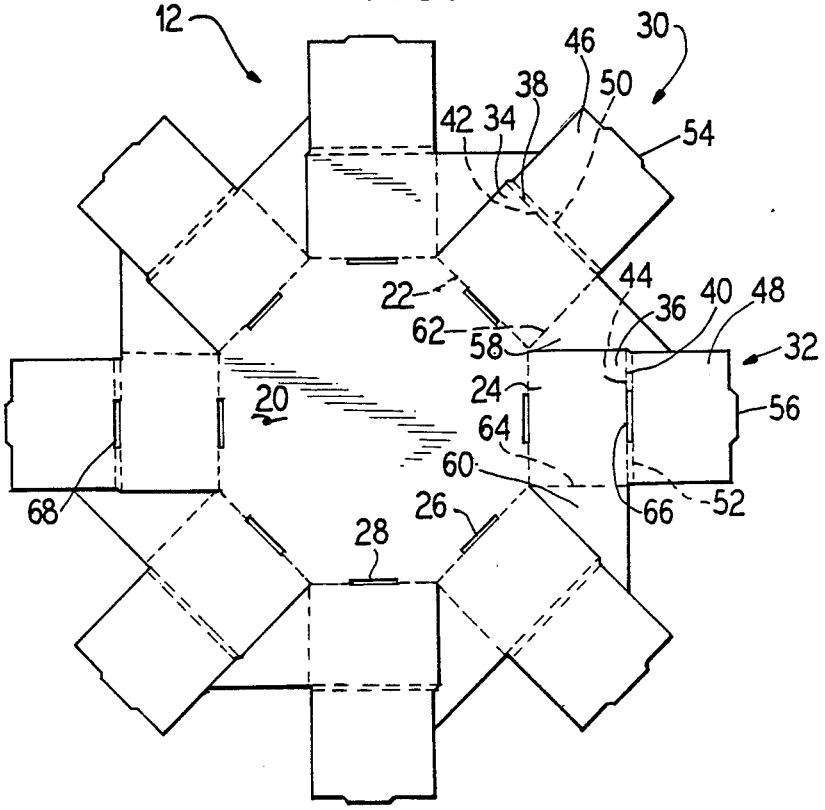

FIG. 4
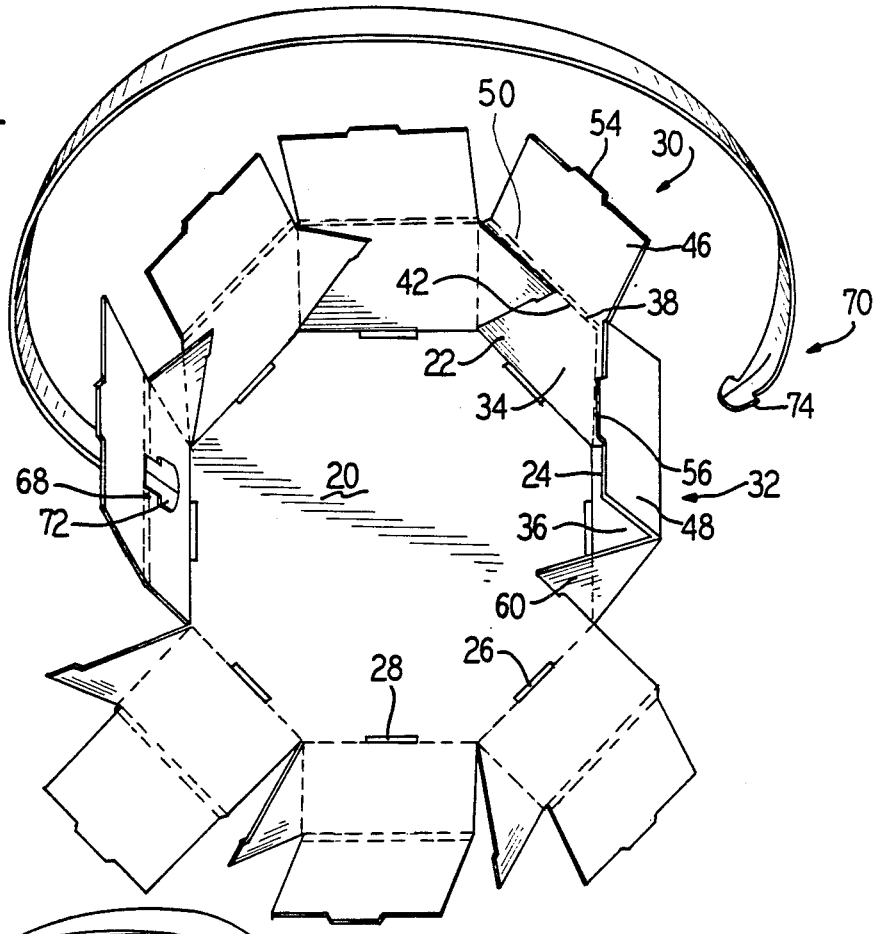
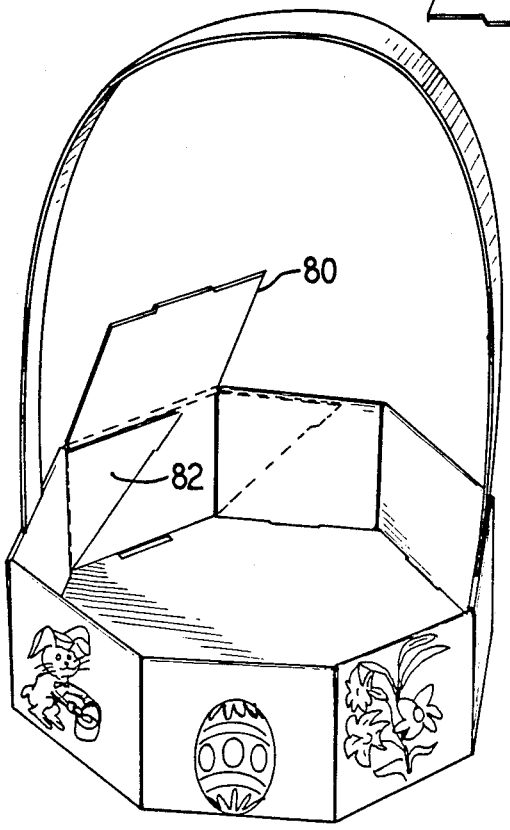
FIG. 5

FOLDABLE BASKET

BACKGROUND OF THE INVENTION

This invention relates to a container construction and more particularly to a foldable cardboard blank for forming a basket-like construction.

There are numerous containers for carrying both utilitarian and decorative objects. One type of container is a basket which includes an object carrying bottom with a handle. Such baskets are used for utilitarian purposes or for decorative purposes, such as in the Easter season to carry Easter eggs or the like in a decorative container.

Many Easter baskets presently formed of a woven straw-like material can be expensive and present some difficulties in shipping and handling.

It is therefore an object of this invention to provide a container construction which is inexpensive to manufacture and is readily shippable.

It is another object of this invention to provide a decorative Easter basket construction which is inexpensive to manufacture and readily shippable.

Paper and cardboard have been used to form various types of articles. An advantage of paper or cardboard is that it can be formed into a blank and then folded to provide the desired ultimate shape or appearance and can have the desired strength.

It is therefore another object of this invention to provide a paper or cardboard blank from which a container can be formed or shaped.

It is another object of this invention to provide an inexpensive foldable container or Easter basket which can be readily shipped.

These and other objects of this invention will become apparent from the following description and appended claims.

SUMMARY OF THE INVENTION

There is provided by this invention a blank which may be folded into a basket or container-like shape so as to provide an inexpensive and easily shipped container or basket-like construction.

The blank is fabricated of die-cut cardboard and includes a central base forming section having a polygonal-peripheral configuration and slot securement means along each polygonal side edge. A tab-like wall-forming section is foldably secured to each side of the polygonally-shaped base. Each of said wall forming sections includes an outer wall forming panel, which is foldably secured at one end to one side of the base along a base score line. A top edge construction is foldably secured to the other end of the outer panel and an inner wall forming panel is secured along one of its ends to the top edge construction. A securement tab is provided at the other end of the inner wall forming panel. A locking panel is foldably secured to one side edge of said outer wall forming panel along a side edge score line. Each of said wall forming sections is adapted to be folded inwardly and upwardly relative to said base along said base score line. Each of said locking panels is adapted to be folded along said side edge score line and be positioned against an inwardly facing surface of an adjacent outer wall forming panel in an overlying relationship. The inner wall forming panel is then folded downwardly and inwardly so as to overlie a locking panel and position a locking panel between the inner and outer panels.

Said inner panel tab securement means is shaped to interfit with said slot securement means in the base for holding said inner and outer panels in position and said locking panel between said inner and outer panels.

When formed, the foldable blank construction forms a container or basket bottom having a base and rigid upstanding walls for holding various objects.

Cardboard handle means are provided for securement to two opposed wall forming sections so that the container may be carried.

Details of the construction are set forth hereinafter.

BRIEF DESCRIPTION OF THE DRAWINGS

FIG. 1 is a perspective view showing an envelope carrying the blank in collapsed form and coloring implements for coloring the blank;

FIG. 2 is a plan view of the container-forming blank in opened form;

FIG. 3 is a plan view of the handle for carrying the container;

FIG. 4 is a perspective view showing a partially assembled blank and carrying handle; and FIG. 5 is a perspective view showing a substantially completely assembled basket having a container and handle.

DESCRIPTION OF THE PREFERRED EMBODIMENT

Referring first to FIG. 1, there is shown an envelope 10 for carrying a collapsed container forming blank 12 and a handle 14. The blank is formed of cardboard and paper and may be printed so as to be decorative. Coloring implements, such as crayons 16, 18, etc., can be provided with the blank with the envelope 10 for forming a kit.

Referring now to FIG. 2, the blank 12 is fabricated of a die-cut cardboard to form the shape shown in FIG. 2. The blank includes a polygonally-shaped base 20, which in this case is eight-sided or octagonally shaped. The periphery of the base is defined by the outer side edges which have score lines, such as 22 and 24. Along each base edge or score line there is provided a centrally positioned locking slot or aperture, such as 26 and 28.

An outwardly extending tab-like wall forming section, such as 30 or 32 generally, is secured at its inner end to the base along the base score edge, such as 22 or 24. Each wall forming section includes an outer wall forming panel, such as 34 or 36. One end of the outer wall forming panel is foldably secured to the base along the base score line, such as 22 or 24. A top edge panel section such as 38 or 40 is provided and foldably secured to the other end of the outer wall forming panel along an outer top edge score line, such as 42 or 44. An inner wall forming panel, such as 46 or 48, is provided and secured along one of its ends to the top edge panel section along an inner top edge score line, such as 50 or 52. A securement tab, such as 54 or 56, is formed on the other or outermost end of the inner panel 46 or 48.

The lateral or side-to-side dimension of the outer panels 34 or 36 is greater than the lateral or side-to-side dimensions of the inner panels 46 or 48. The top edge panel section is tapered along its side edges to provide a transition between the inner and outer panels of different lateral dimensions. The smaller lateral dimension for the inner panel is necessary so as to permit all of the inner panels to be assembled and fit together. The inner panels when assembled lay along a smaller periphery or circumference than the outer panels, and thus the inner panels must be slightly smaller than the outer panels so as to accommodate the differences in periphery.

Triangularly-shaped locking panels, such as 58 and 60, are secured along a side edge score line, such as 62 or 64, to the outer panels 34 and 36.

These locking panels are constructed so as to cooperate in holding the various walls in an upright position by interfitting with adjacent wall constructions. It is seen that each locking panel extends along the side edge between the base score line and the outer top edge score line. Also, the upper edge of the locking panels extends from the outer panel, such as 34, of one wall section to the inner panel 48 of an adjacent wall section. However, it is also noted that the lateral dimension of the locking panel is less than the lateral dimension of either the inner or outer wall forming sections.

Basket handle receiving slots, such as 66 and 68, are cut in the top edge panel section, such as 40, in two oppositely disposed wall forming sections.

A cardboard handle blank 70 is shown in FIG. 4 and includes enlarged ends 72 and 74 which define container engaging shoulders, such as 72*a* and 72*b*. In order to permit assembly, each of the ends is cut along a line such as at 72*c* so as to define two end sections which can be folded and manipulated into the slots but yet be opened so that the engaging shoulders 72*a* and 72*b* can engage and hold the container. The outer faces of the container wall, such as 34, are decorated with appropriate indicia which can be colored.

Referring now to FIG. 4, the container is shown partially assembled. The base 20 is seen and in that view the tab-like wall forming sections 30 and 32 have been folded upwardly and inwardly along the base score lines 22 and 24.

The locking tabs, such as 60, are folded inwardly so as to lie against the inner surface of the outer wall forming panels, such as 34 and 36. Next, the inner wall forming panels, such as 46 and 48, are folded inwardly and downwardly over the locking tab and along the outer top edge score lines, such as 42 and 44. The width of the top edge panel sections 38 and 40 is equal to or greater than the thickness of the cardboard so as to fit over the locking tab. If a basket handle, such as 70, is to be used, the ends 72 and 74 are collapsed along the line, such as 72c, and inserted into the respective handle receiving slots, such as 68, and opened to an engaging position. The head is larger than the slot.

Next, the inner wall forming panels, such as 48, are folded inwardly and downwardly along score lines 50 and 52 over the locking panel and over the enlarged heads of the basket 72, if appropriate. As a result, the inner panels overlie the locking panel and securely position the locking panel between the inner and outer panels. Upward movement of the locking panel is prevented by engagement of the upper edge of the locking panel with the top edge, such as 38, of the walls.

The inner wall panels are locked in position by engagement of the securement tabs 54 and 56 with the securement slots, such as 26 and 28, cut in the base. This securement traps the locking panel between the inner and outer panels and also forces the upright positioning and formation of the wall by the inner and outer panels, such as 34 and 46.

FIG. 5 shows a basket in almost complete form with indicia, such as an Easter rabbit, an Easter egg, and Easter flowers, printed on the outer side of the outer panels. In the view of FIG. 5, final assembly of the basket is shown in which an inner panel 80 is about to be folded over a locking tab 82 from an adjacent section so as to form the upstanding wall.

It will be appreciated that various panel sections are folded in sequence around the periphery of the base. In other words, a first tab-like wall section is folded upwardly, then a second one is folded for trapping the locking tab of the first panel, and the third wall section is folded upwardly and traps the locking tab in the second panel, etc., until the wall construction is completed.

Although the invention has been described with respect to a preferred embodiment, changes and modifications can be made which are within the full intended scope of the invention as defined by the appended claims.

I claim as my invention:

1. In combination, a blank for folding into a basket-like container having a base and upright side walls and a handle for cooperation with said blank and for use in carrying said container;

A. said blank comprising:

1. a central base forming section having a polygonal configuration and means defining a securement slot in the base along each polygonal side edge;
2. a foldable tab-like wall forming section secured to each side of said polygonally-shaped base, each of said wall forming sections including:
   (a) an outer wall forming panel which is foldably secured at one end to the base section along a base edge score line, said outer panel having a top edge opposite said base end, and a top edge score line;
   (b) a top edge panel section foldably secured along an outer top end to the outer panel section along an outer top edge score line, having an inner top end opposite said outer top end and having an inner top end score line, said inner top edge being shorter than said outer top edge and having lateral side edges which join said inner and outer ends which side edges are tapered;
   (c) at least two opposite top edge panels, each defining a handle receiving slot having a predetermined length;
   (d) an inner wall forming panel foldably secured at one end to the top edge panel section at the inner top end score line, having an inner bottom end, and defining tab securement means for locking cooperation with the base securement slot;
   (e) the inner wall panel having a lateral dimension less than the lateral dimension of the outer wall forming panel; and
   (f) a locking panel foldably secured to a side edge of said outer wall forming panel along a side edge score line;

B. elongated handle defining means for carrying the container in a basket-like manner, said handle defining means having enlarged ends, each of which define shoulder portions of a length greater than the predetermined length of the top edge handle receiving slot, each enlarged end having a slit so as to permit the slitted ends to overlap for insertion into a handle receiving slot and to be expanded to a top edge panel section engaging position between said inner and outer panels.

C. each of said wall forming sections adapted to be folded inwardly and upwardly relative to the base along a base score line, said locking panel adapted to be folded along a side edge score line and positioned against an inwardly facing surface of adjacent outer wall forming panel and in overlying relationship thereto, and said inner wall forming panel adapted to be folded inwardly and downwardly so as to overlie a locking panel and position the locking panel between the inner and outer panels, said inner panel tab securement means adapted to interfit with said base securement slot means for holding said inner and outer panels in position and said locking tab between the inner and outer panels.

2. A container as in claim 1, wherein said base is eight-sided.

3. A container as in claim 1, wherein the lateral dimension of the locking panel is less than the lateral dimensions of the inner or outer wall panel sections.

4. A container as in claim 3, wherein the side edge score line along which the locking panel is secured to the outer panel extends from the base edge score line to the outer top edge score line.

5. A container as in claim 1, wherein the distance width between the inner and outer top edge score lines is less than the thickness of the locking panel.

6. A container as in claim 1 wherein an indicia is provided on the outer surfaces of the outer panel, which indicia is adapted to be colored.

7. A container and basket handle as in claim 6, and in combination therewith, a plurality of coloring implements and envelope means for carrying said blank, handle and coloring implements so as to define a kit.

* * * * *